US006408830B1

(12) United States Patent
McGrath

(10) Patent No.: US 6,408,830 B1
(45) Date of Patent: Jun. 25, 2002

(54) FUEL PUMP MODULE FOR A FUEL TANK

(75) Inventor: Dennis Paul McGrath, Ortonville, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/746,544

(22) Filed: Dec. 15, 2000

(51) Int. Cl.[7] ..... F02M 37/10
(52) U.S. Cl. ..... 123/509; 123/514; 137/572
(58) Field of Search ..... 123/509, 510, 123/514, 516; 137/572, 574, 575, 576

(56) References Cited

U.S. PATENT DOCUMENTS 3,968,896 A 7/1976 Giacoletti et al. ..... 73/306
4,852,761 A 8/1989 Turner et al. ..... 220/746
5,218,942 A 6/1993 Coha et al. ..... 123/514
5,363,827 A * 11/1994 Siekmann ..... 123/509
5,456,238 A * 10/1995 Porter ..... 123/509
5,660,206 A 8/1997 Neal et al. ..... 137/592
5,769,061 A * 6/1998 Nagata et al. ..... 123/509

* cited by examiner

*Primary Examiner*—Tony M. Argenbright
(74) *Attorney, Agent, or Firm*—Vincent A. Cichosz

(57) ABSTRACT

A fuel pump module for a fuel tank in a vehicle includes a reservoir adapted to be disposed in the fuel tank and a partition disposed in the reservoir to divide the reservoir into a fuel sensing chamber and a fuel storage chamber. The fuel pump module also includes a conduit conducting return fuel from an engine of the vehicle to the fuel storage chamber of the reservoir. The fuel pump module includes a fuel pump disposed in the reservoir and having an inlet disposed in the fuel sensing chamber and an outlet disposed in the fuel storage chamber. The fuel pump module further includes a fuel usage priority valve to allow fuel from the fuel storage chamber to flow to the fuel sensing chamber to provide the inlet of the fuel pump with fuel from the fuel storage chamber.

20 Claims, 1 Drawing Sheet

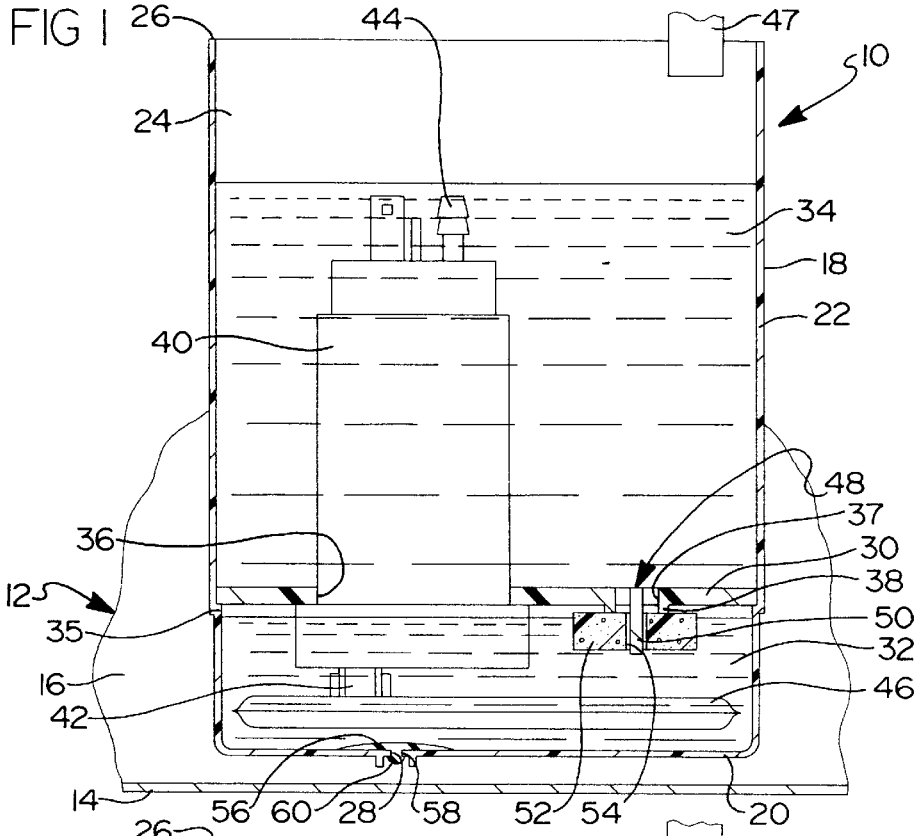
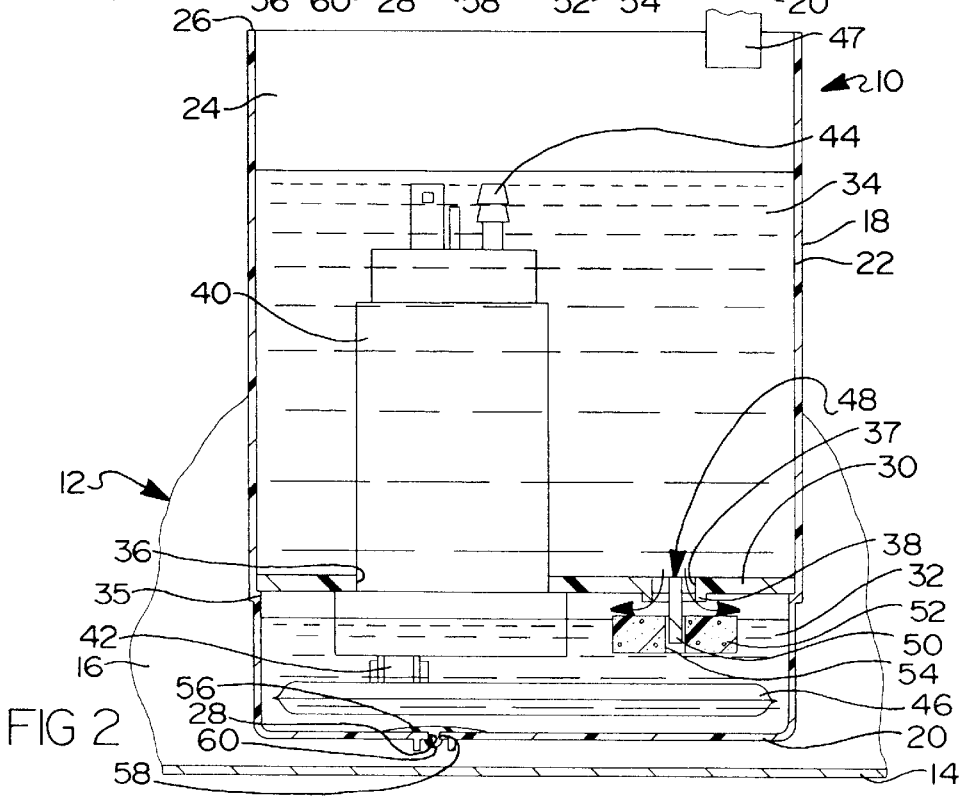
FIG 2

FUEL PUMP MODULE FOR A FUEL TANK

TECHNICAL FIELD

The present invention relates generally to fuel tanks for vehicles and, more particularly, to a fuel pump module for a fuel tank of a vehicle.

BACKGROUND OF THE INVENTION

It is known to provide a fuel tank for a vehicle to hold fuel to be used by an engine of the vehicle. In some vehicles, the fuel tank includes a fuel pump module disposed therein with a removable cover sealed to the top of the fuel tank having an electrical connector and a fuel line outlet connector. The fuel pump module includes a fuel reservoir, an electrical fuel pump disposed in the reservoir with an inlet at a bottom thereof, and a secondary pump used to fill the reservoir to overfilling. This overfilling of the reservoir allows the generation of vapors due to the agitation of the fuel as well as the mixing of the hot fuel, being returned from an engine of the vehicle, with bulk fuel.

An example of a fuel pump module is disclosed in U.S. Pat. No. 5,218,942 to Coha et al. In this patent, the fuel pump module includes a fuel pump disposed in the reservoir, a low pressure conduit conducting hot return fuel back to the reservoir, a secondary pump disposed in the reservoir for pumping new fuel from the fuel tank into the reservoir, and a control which effects a recirculation mode of secondary pump operation when the new fuel level in the fuel tank is above a predetermined low level and a scavenge mode of secondary pump operation when the new fuel level in the reservoir is below the predetermined low level. The secondary pump includes a high-pressure jet pump having consistent flow and a float mechanism to switch the jet pump from drawing external fuel to the reservoir and vice versa. However, these jet pumps result in fuel pump modules that generate fuel vapors, which is undesired. Further, these jet pumps are relatively costly due to the components and assembly of the components.

Therefore, it is desirable to provide a new fuel pump module for a fuel tank in a vehicle. It is also desirable to provide a fuel pump module for a fuel tank in a vehicle that reduces vapor generation. It is further desirable to provide a fuel pump module for a fuel tank in a vehicle that eliminates jet pumps to fill the reservoir.

SUMMARY OF THE INVENTION

It is, therefore, one object of the present invention to provide a new fuel pump module for a fuel tank in a vehicle.

It is another object of the present invention to provide a fuel pump module for a fuel tank that has a reservoir fill and containment system.

To achieve the foregoing objects, the present invention is a fuel pump module for a fuel tank in a vehicle including a reservoir adapted to be disposed in the fuel tank and a partition disposed in the reservoir to divide the reservoir into a fuel sensing chamber and a fuel storage chamber. The fuel pump module also includes a conduit conducting return fuel from an engine of the vehicle to the fuel storage chamber of the reservoir. The fuel pump module includes a fuel pump disposed in the reservoir and having an inlet disposed in the fuel sensing chamber and an outlet disposed in the fuel storage chamber. The fuel pump module further includes a fuel usage priority valve to allow fuel from the fuel storage chamber to flow to the fuel sensing chamber to provide the inlet of the fuel pump with fuel from the fuel storage chamber.

One advantage of the present invention is that a new fuel pump module is provided for a fuel tank in a vehicle. Another advantage of the present invention is that the fuel pump module improves performance by eliminating parasitic losses to the fuel pump associated with jet pump operation and during switching function as no air is ingested during "switch" period. Yet another advantage of the present invention is that the fuel pump module has no depletion of fuel pump output to run an aspirator as in a high pressure jet pump and no increase or fluctuation in return line pressures, as in return line jet pumps. Still another advantage of the present invention is that the fuel pump module, when operated in contained mode, delivers fuel in the reservoir to the fuel pump, which is cleaner than bulk fuel. A further advantage of the present invention is that the fuel pump module reduces cost because of the elimination of all jet pump components and assembly stations to install these components and allows usage of a smaller, lower cost fuel strainer for the fuel pump. Yet a further advantage of the present invention is that the fuel pump module improves quality by the elimination of press fits and high-pressure connections in the return fuel line, allowing simplified assembly and reduction in part count of the fuel pump module.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 1 is a fragmentary elevational view of a fuel pump module, according to the present invention, illustrated in a first operational mode with a fuel tank of a vehicle.

FIG. 2 is a view similar to FIG. 1 illustrating the fuel pump module in a second operational mode.

DESCRIPTION OF THE PREFERRED EMBODIMENT

Referring to the drawings and in particular FIGS. 1 and 2, one embodiment of a fuel pump module 10, according to the present invention, is shown for a fuel tank, generally indicated at 12, in a vehicle (not shown). In this embodiment, the fuel tank 12 has a bottom wall 14 and a side wall 16 around a periphery of the bottom wall 14 and extending generally perpendicular thereto. The fuel tank 12 has a top wall (not shown) around a periphery of the side wall 16 and extending generally perpendicular thereto. The fuel tank 12 is made of a rigid material such as plastic. It should be appreciated that, except for the fuel pump module 10, the fuel tank 12 is conventional and known in the art.

The fuel pump module 10 includes a fuel reservoir 18 to hold fuel disposed inside the fuel tank 12. The fuel reservoir 18 has a bottom portion 20 and an annular side portion 22 extending generally perpendicularly from the bottom portion 20 to form a chamber 24. The fuel reservoir 18 is generally bucket-shaped and open at a top end 26 thereof, which defines an overflow fuel level in the fuel reservoir 18. The fuel reservoir 18 also has an inlet 28 formed in the bottom portion 20. The inlet 28 is generally circular in shape. The fuel reservoir 18 is integral, unitary, and one-piece. The fuel reservoir 18 is made of a rigid material such as plastic. It should be appreciated that the top end 26 is above the highest level of new fuel in the fuel tank 12 so that there is little or no in-and-out flow over the top. It should also be appreciated that the top end 26 may be partially closed to minimize splash-over while still venting the interior of the fuel reservoir 18.

The fuel pump module 10 also includes a partition 30 disposed in the fuel reservoir 18 to divide the chamber 24 into a fuel sensing chamber 32 and a fuel storage chamber 34. The partition 30 is generally circular in shape and disposed in the fuel reservoir 18 to rest or seat on a shoulder 35 of the side portion 22 of the fuel reservoir 18. The partition 30 has a first aperture 36 extending axially therethrough. The first aperture 36 is generally circular in shape for a function to be described. The partition 30 has a second aperture 37 spaced radially from the first aperture 36 and extending axially therethrough. The second aperture 37 is generally circular in shape for a function to be described. The second aperture 37 has a diameter less than a diameter of the first aperture 36. The partition 30 also has an annular flange 38 surrounding the second aperture 37 and extending axially into the fuel sensing chamber 32 for a function to be described. The partition 30 is integral, unitary, and formed as one-piece. The partition 30 is made of a rigid material such as plastic.

The fuel pump module 10 also includes a fuel pump 40 disposed in the fuel reservoir 18. The fuel pump 40 is of a high-pressure electric fuel pump type. The fuel pump 40 extends axially and is generally cylindrical and circular cross-sectional shape. The fuel pump 40 extends through the first aperture 36 and has an inlet 42 in a bottom thereof that is disposed in the fuel sensing chamber 32 and an outlet 44 at a top thereof that is disposed in the fuel storage chamber 34. The outlet 44 is connected by a hose (not shown) to a fuel module cover (not shown) to communicate fuel to an engine (not shown) of the vehicle. It should be appreciated that the fuel pump 40 is also connected by wires (not shown) to a source of electrical power such as a controller (not shown). It should also be appreciated that the fuel pump 40 is supported by the partition 30 in the chamber 24 of the fuel reservoir 18. It should further be appreciated that the fuel pump 40 is conventional and known in the art.

The fuel pump module 10 includes a fuel strainer 46 disposed in the fuel sensing chamber 32 and connected to the inlet 42 to strain contaminants from the fuel before entering the inlet 42. It should be appreciated that the fuel strainer 46 minimizes or prevents the ingestion of air or vapor and to strain contaminants such as dirt from the fuel before traveling to the fuel pump 40. It should also be appreciated that the fuel strainer 46 is conventional and known in the art.

The fuel pump module 10 also includes a return fuel conduit 47 for returning fuel to the fuel reservoir 18. The return fuel conduit 47 has one end connected to the engine (not shown) and another end extending into the fuel storage chamber 34 of the fuel reservoir 18. It should be appreciated that the return fuel conduit 47 is conventional and known in the art.

The fuel pump module 10 further includes a fuel usage priority valve, generally indicated at 48, disposed in the fuel reservoir 18 to provide uninterrupted fuel delivery to the fuel pump 40. The fuel usage priority valve 48 includes a rod 50 extending axially from the partition 30 into the fuel sensing chamber 32. The rod 50 is supported by the partition 30 in the second aperture 37. The rod 50 is generally cylindrical and has a generally circular cross-sectional shape. The rod 50 may be integral and formed as one-piece with the partition 30. The fuel usage priority valve 48 also includes a fuel sensing element 52 disposed about the rod 50 and moveable therealong. The fuel sensing element 52 is generally circular in shape and has an aperture 54 extending therethrough to receive the rod 50. The fuel sensing element 52 is made of a material having a density less than a density of the fuel similar to a float. It should be appreciated that the fuel sensing element 52 is movable up and down along the rod 50 as the fuel level in the fuel sensing chamber 32 rises and falls. It should also be appreciated that the fuel sensing element 52 cooperates with the flange 38 which acts as a valve seat to open and close the second aperture 37 based on the level of fuel in the fuel sensing chamber 32. It should further be appreciated that the fuel in the fuel sensing chamber 32 holds the fuel sensing element 52 about the rod 50 to prevent the fuel sensing element 52 from exiting the rod 50.

The fuel pump module 10 includes an anti-siphon valve 56 disposed in the inlet 28 to prevent siphoning of fuel from the fuel reservoir 18. The anti-siphon valve 56 is a circular shaped member having a shaft 58 extending through the inlet 28. The shaft 58 includes a flange 60 extending outwardly to prevent the anti-siphon valve 56 from exiting the inlet 28. It should be appreciated that the anti-siphon valve 56 prevents fuel from siphoning backwards from the intended direction of flow when the fuel pump module 10 is not operating.

In operation, the fuel pump module 10 is illustrated in a first operational mode in FIG. 1 in which fuel is disposed in the fuel reservoir 18. During initial operation or when the vehicle is first started, bulk fuel flows freely through the inlet 28 and into the fuel sensing chamber 32 to supply fuel to the inlet 42 of the fuel pump 40. The sensing element 52 starts out open allowing all return fuel from the return fuel conduit 47 into the fuel storage chamber 34 to feed the fuel pump 40 and slowly closes as fuel level in the fuel sensing chamber 32 rises. The fuel sensing element 52 then seats against the flange 38 and closes the second aperture 37 to prevent fuel in the reservoir storage chamber 34 to be supplied to the inlet 42 of the fuel pump 40. When no bulk fuel is available or when the bulk fuel supply is interrupted for any reason, the fuel volume in the fuel sensing chamber 32 is diminished due to usage by the fuel pump 40. This causes the fuel sensing element 52 to immediately move off the flange 38 and open the second aperture 37 to allow fuel from the fuel storage chamber 34 to flow through the second aperture 37 to be delivered to the fuel pump 40 as illustrated in FIG. 2, preventing any interruption in fuel delivery to the engine. This process is repeated until the fuel tank 12 is completely empty. It should be appreciated that returning fuel from the engine is supplied back into the fuel storage chamber 34 via the return fuel conduit 47.

The fuel pump module 10 also allows containment of hot fuel within the fuel reservoir 18 if desired. To contain hot fuel, the area of the second aperture 37 need only be sized so that, at the desired height of fuel in the fuel reservoir 18, the head pressure of fuel will defeat the buoyancy of the fuel sensing element 52 and cause fuel in the fuel reservoir 18 to be delivered to the inlet 42 of the fuel pump 40. The heated return fuel entering the reservoir storage chamber 34 can be constantly recirculated and prevented from spilling out of the fuel reservoir 18, keeping the temperature of the fuel tank 12 as low as possible.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel pump module for a fuel tank in a vehicle comprising:

a reservoir adapted to be disposed in the fuel tank;

a partition disposed in said reservoir to divide said reservoir into a fuel sensing chamber and a fuel storage chamber;

a conduit conducting return fuel from an engine of the vehicle to said fuel storage chamber of said reservoir;

a fuel pump disposed in said reservoir and having an inlet disposed in said fuel sensing chamber and an outlet disposed in said fuel storage chamber; and a fuel usage priority valve to allow fuel from said fuel storage chamber to flow to said fuel sensing chamber to provide said inlet of said fuel pump with fuel from said fuel storage chamber.

2. A fuel pump module as set forth in claim 1 wherein said partition includes a first aperture extending axially therethrough, said fuel pump extending through said first aperture.

3. A fuel pump module as set forth in claim 2 wherein said partition includes a second aperture spaced radially from said first aperture and extending axially therethrough.

4. A fuel pump module as set forth in claim 3 wherein said fuel usage priority valve is disposed in said fuel sensing chamber and cooperates with said second aperture.

5. A fuel pump module as set forth in claim 3 wherein said fuel usage priority valve comprises a fuel sensing element to open and close said second aperture.

6. A fuel pump module as set forth in claim 5 wherein said fuel usage priority valve includes a rod extending from said partition, said fuel sensing element being disposed about said rod and moveable therealong.

7. A fuel pump module as set forth in claim 5 wherein said fuel sensing element has a density less than a density of said fuel.

8. A fuel pump module as set forth in claim 5 wherein said partition includes an annular flange disposed about said second aperture and extending axially to cooperate with said fuel sensing element.

9. A fuel pump module as set forth in claim 1 wherein said fuel reservoir includes a shoulder extending radially therein, said shoulder supporting said partition.

10. A fuel pump module as set forth in claim 1 including a fuel strainer disposed in said fuel sensing chamber and connected to said inlet of said fuel pump to strain fuel flowing therein.

11. A fuel pump module as set forth in claim 1 including an anti-siphon valve disposed within said fuel sensing chamber to prevent fuel siphoning from said fuel reservoir.

12. A fuel pump module for a fuel tank in a vehicle comprising:

a reservoir adapted to be disposed in the fuel tank;

a partition disposed in said reservoir to divide said reservoir into a fuel sensing chamber and a fuel storage chamber and having a first aperture extending therethrough and a second aperture spaced from said first aperture extending therethrough;

a conduit conducting return fuel from an engine of the vehicle to said fuel storage chamber of said reservoir;

a fuel pump disposed in said reservoir and extending through said first aperture, said fuel pump having an inlet disposed in said fuel sensing chamber and an outlet disposed in said fuel storage chamber; and a fuel usage priority valve disposed in said fuel sensing chamber and cooperating with said second aperture to allow fuel from said fuel storage chamber to flow to said fuel sensing chamber to provide said inlet of said fuel pump with fuel from said fuel storage chamber.

13. A fuel pump module as set forth in claim 12 wherein said fuel usage priority valve comprises a fuel sensing element to open and close said second aperture.

14. A fuel pump module as set forth in claim 13 wherein said fuel usage priority valve includes a rod extending from said partition, said fuel sensing element being disposed about said rod and moveable therealong.

15. A fuel pump module as set forth in claim 13 wherein said fuel sensing element has a density less than a density of said fuel.

16. A fuel pump module as set forth in claim 13 wherein said partition includes an annular flange disposed about said second aperture and extending axially to cooperate with said fuel sensing element.

17. A fuel pump module as set forth in claim 12 wherein said fuel reservoir includes a shoulder extending radially therein, said shoulder supporting said partition.

18. A fuel pump module as set forth in claim 12 including a fuel strainer disposed in said fuel sensing chamber and connected to said inlet of said fuel pump to strain fuel flowing therein.

19. A fuel pump module as set forth in claim 12 including an anti-siphon valve disposed within said fuel sensing chamber to prevent fuel siphoning from said fuel reservoir.

20. A fuel tank assembly for a vehicle comprising:

a fuel tank;

a fuel reservoir disposed in said fuel tank;

a partition disposed in said fuel reservoir to divide said fuel reservoir into a fuel sensing chamber and a fuel storage chamber and having a first aperture extending therethrough and a second aperture spaced from said first aperture extending therethrough;

a conduit conducting return fuel from an engine of the vehicle to said fuel storage chamber of said fuel reservoir;

a fuel pump disposed in said fuel reservoir and extending through said first aperture, said fuel pump having an inlet disposed in said fuel sensing chamber and an outlet disposed in said fuel storage chamber; and a fuel usage priority valve disposed in said fuel sensing chamber and cooperating with said second aperture to allow fuel from said fuel storage chamber to flow to said fuel sensing chamber to provide said inlet of said fuel pump with fuel from said fuel storage chamber.

* * * * *